United States Patent [19]

Zwald

[11] 4,393,583

[45] Jul. 19, 1983

[54] ANTI-TORQUE CONNECTION APPARATUS AND METHOD FOR USING

[75] Inventor: Henry J. Zwald, Mesa, Ariz.

[73] Assignee: Motorola Inc., Schaumburg, Ill.

[21] Appl. No.: 244,583

[22] Filed: Mar. 17, 1981

[51] Int. Cl.[3] ..... H01R 43/00; B25B 13/00

[52] U.S. Cl. ..... 29/857; 81/55; 81/121 A

[58] Field of Search ..... 81/55, 582, 121 A; 29/828, 857

[56] References Cited

U.S. PATENT DOCUMENTS

| | | | |
|---|---|---|---|
| 593,442 | 11/1897 | Tailleur . | |
| 2,772,590 | 12/1956 | Werries | 81/55 |
| 2,790,343 | 4/1957 | White | 81/55 |
| 3,147,057 | 9/1964 | Colussi . | |
| 3,171,707 | 2/1965 | Powell . | |
| 3,277,749 | 10/1966 | Osburn et al. | 81/55 X |
| 3,633,446 | 1/1972 | Tadahira et al. | 81/55 X |
| 3,673,314 | 6/1972 | Zimmermann et al. . | |
| 3,889,558 | 6/1975 | Duncan | 81/55 |

OTHER PUBLICATIONS

Ford Motor Co. Service Publication, Ford Marketing Corp. 17-15-4 (1970).

*Primary Examiner*—Francis S. Husar
*Assistant Examiner*—Carl J. Arbes
*Attorney, Agent, or Firm*—Lewis S. Gruber; Eugene A. Parsons

[57] ABSTRACT

An anti-torque coaxial cable connection apparatus comprising a cylindrical nut driver having a cut away portion alignable with a slot in a coaxial cylindrical wrench having a portion shaped to engage a cable adaptor having a cable adaptor portion adapted to be firmly engaged by said wrench. The alignment of the nut driver cutaway and the wrench slot forms an aperture which can be aligned over a cable inelastically joined to a cable adaptor to allow tightening in situ of a cable connector comprising a cable adaptor and a nut without interfering with said cable while the cable adaptor is firmly held to prevent damage to said inelastic joint.

2 Claims, 7 Drawing Figures

ANTI-TORQUE CONNECTION APPARATUS AND METHOD FOR USING

BACKGROUND OF THE INVENTION

The present invention relates to coaxial cable connection apparatus and in particular to anti-torque microwave cable connection apparatus.

Cable connectors typically consist of a cable adaptor and a nut coaxially and rotatably mounted around the adaptor. An end of a cable to be connected might be rigidly attached to the cable adaptor by means of a stiff solder joint, for example. The nut can be rotatably tightened to urge the cable adaptor and the attached cable toward a mating device such as a terminal or such as a sleeve coupled to another adaptor as in U.S. Pat. No. 3,147,057, entitled "Coaxial Connector". When the nut is tightened to the terminal or sleeve, torque is frictionally transmitted to the adaptor and thence to any solder joint between the cable and the adaptor. This transmitted torque poses a particular problem in coaxial cables having a solid tubular outer conductor soldered to the adaptor. The transmitted torque weakens the solder joint. If the joint breaks when torque is applied, the failure is readily apparent. If the joint does not break immediately, the strain-induced weakness may cause the solder joint to fail at a later date.

This problem has been approached by resoldering the joint when it breaks. An important obstacle to the use of preventative measures has been the lack of a convenient tool for tightening the nut while immobilizing the solder joint, especially in light of the fact that the terminals or sleeves to which the cable connectors are to be tightened may be in locations that are accessible only with difficulty. It is understood by one skilled in the art that although solder joints are specifically referred to herein, any inelastic, fragile or brittle joint between a cable adaptor and a cable, such as an inflexible adhesive joint, would present similar problems and be similarly susceptible to the solution of the present invention. It is also understood by one skilled in the art that while coaxial cables having a solid outer conductor are specified herein, the present invention could also be applied to coaxial cables having a braided outer conductor.

SUMMARY OF THE INVENTION

Accordingly, it is an object of the present invention to provide a nut driver slotted to slide over a cable and shaped so as to allow cooperative use of an anti-torque spanner or other wrench.

Another object of the present invention is to provide an anti-torque spanner or other wrench shaped to fit over a cable and to work cooperatively with a nut driver.

Still another object of the present invention is to provide a new and improved method of using an anti-torque spanner or other wrench cooperatively with an anti-torque nut driver to tighten the nut on a cable connector while firmly holding the cable adaptor portion of the connector so as to preserve the solder joint between the adaptor and the cable.

These and other objects of this invention will become apparent to those skilled in the art upon consideration of the accompanying specification, claims and drawings.

In order to attain the above mentioned and other objects and advantages, the present invention comprises an apparatus for tightening a cable connector having at least a cable adaptor and a nut, said apparatus being composed of a tool, said tool having a portion shaped to allow said tool to firmly engage said adaptor without interferring with said cable, and a nut driver, said nut driver being rotatably disposed around said tool so that said nut driver can tighten the nut of the cable connector while the cable adaptor is firmly held by said tool. In addition, the present invention involves a method of tightening a cable connector comprising the steps of providing a cable connector having a cable adaptor and having a nut rotatably disposed around said cable adaptor, rotatably disposing a nut driver around a tool adapted for firmly holding said cable adaptor, engaging said nut in said nut driver, firmly holding said cable adaptor with said tool, and rotating said nut driver to tighten said nut to a mating device.

An important advantage of the present invention over the prior art is the ability to couple a coaxial cable to a terminal by way of a cable connector, even in relatively inaccessible locations, while at the same time preserving the integrity of the solder joint between the cable and the connector.

DESCRIPTION OF THE PREFERRED EMBODIMENT

Figure 1A:
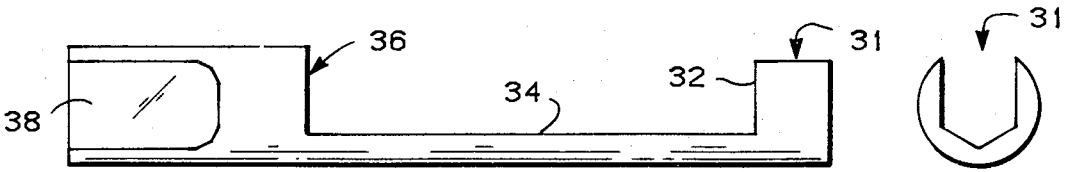
FIGS. 1A and 1B show a nut driver according to the present invention.
Figure 1B:
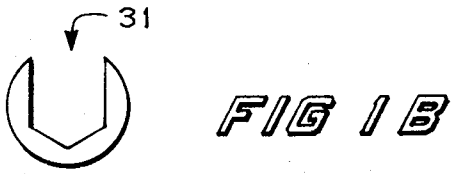

In a preferred embodiment of the cable connection apparatus of the present invention, as illustrated in FIG. 1A, nut driver 30 can be seen to be composed of flat grasping surface 38, hollow cylindrical portion 36, connecting portion 34, slot 31 and nut engagement portion 32. As can be seen in the end view of FIG. 1B, nut engagement portion 32 is shaped so as to be capable of firmly engaging a hexagonal portion of the nut portion of a cable connector.

Figure 2A:
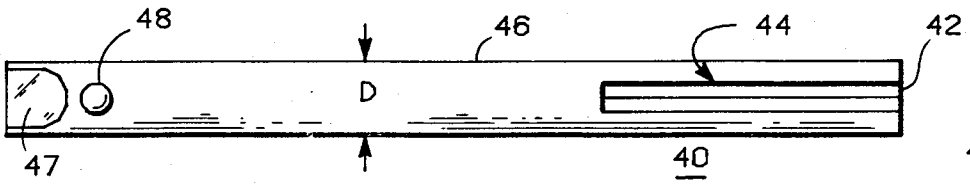
FIGS. 2A and 2B show a wrench according to the present invention.
Figure 2B:
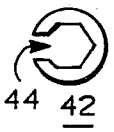
Figure 3:
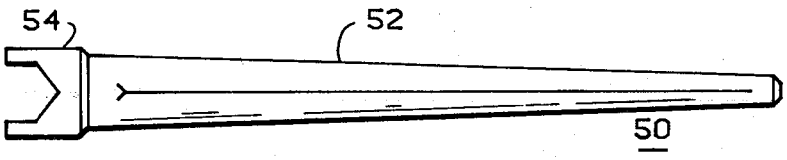
FIG. 3 depicts an alternative embodiment of a wrench according to the present invention.
Figure 4:
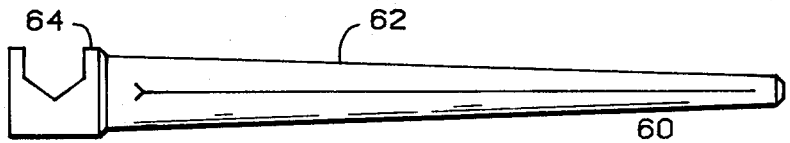
FIG. 4 illustrates yet another alternative embodiment of a wrench according to the present invention.

In FIGS. 2A and 2B, wrench 40 can be seen to be composed of adaptor engagement portion 42, slot 44, cylindrical portion 46, flat grasping surface 47 and handle 48. The largest dimension D of wrench 40 must be small enough to pass through the hollow portion of hollow cylindrical portion 36 and within the confines of nut engagement portion 32. Coaxial cable connectors with shaped adaptor portions suitable for use or adaption for use with embodiments of the present invention are available from Solitron/Microwave Division, Solitron Devices, Inc., Port Salerno, Fla., and from Americon, Waltham, Mass. A method of using such a connector with the present invention is illustrated in FIG. 5.

Figure 5:
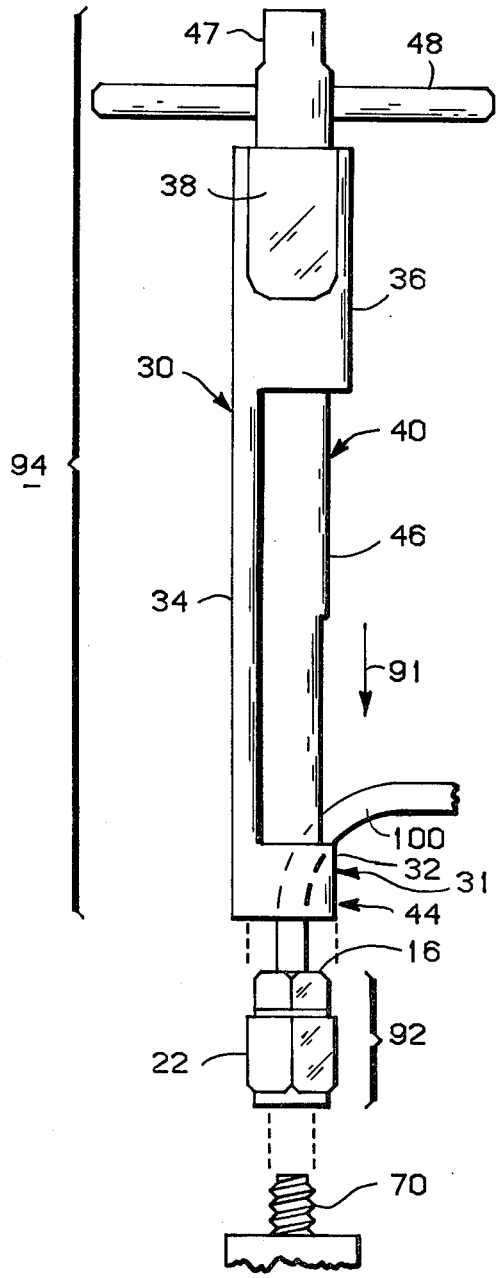
FIG. 5 depicts a preferred assembly for practicing a method of tightening a cable connector to a terminal according to the present invention.

As can be seen in FIG. 5, in which structures from FIGS. 1A, 1B, 2A, 2B, 3 and 4 are indicated by like numerals, wrench 40 can be slipped within nut driver 30 so that slot 44 is aligned with the open portion of nut engagement portion 32 and so that the aligned combination of slots can be slipped over a cable 100 which is connected to cable connector 92. Cable connector 92 can be threadedly engaged and tightened to threaded terminal 70 by threadedly engaging hexagonally shaped nut 22 to terminal 70, slipping cable connector tightening apparatus 94 over cable 100, engaging nut driver 30 with hexagonally shaped nut portion 22, firmly engaging inner wrench 40 with hexagonally shaped cable adaptor 16, and turning nut driver 30 to tighten cable connector 92 while firmly holding handle 48 of inner wrench 40 to prevent rotation of adaptor portion 16 with respect to cable 100. This operation can be repeated as many times as are necessary to tighten cable connector 92 against terminal 70 to the desired degree without disturbing the connector 92, cable 100 interface.

While the present invention has been described in terms of a preferred embodiment, further modification and improvements will occur the those skilled in the art. For example, where access to terminal 70 is restricted or the angle of attachment of cable 100 does not permit the use of a vertically slotted cylindrical wrench as shown in FIG. 2A, one skilled in the art could select from a variety of flat wrenches having adaptor engagement portions oriented at various convenient angles. Examples of such wrenches can be seen in FIG. 3 where wrench 50 displays an adaptor engagement portion 54 oriented in line with handle 52 while in FIG. 4 wrench 60 exhibits an adaptor engagement portion 64 oriented perpendicularly to handle 62. Of course, other angles of handle to opening are also available. Onlce a flat wrench having a convenient angle is chosen, the adaptor engagement portion can be introduced within the circumference of nut driver 30 in the cutaway region between nut engagement portion 32 and hollow cylindrical portion 36. Nut driver 30 can then be rotated while adaptor 16 is held by the engagement portion of the flat wrench. It is intended that these and other modifications occurring to those skilled in the art should be comprehended with the present description of a device having a coaxial fixedly held adaptor engagement portion and a rotatable nut engagement portion. Likewise it is obvious to one skilled in the art that connector engagement systems other than a hexagonal wrench for engaging a hexagonal shoulder could be employed. As examples, it would be obvious to use other shapes and numbers of engagement surfaces or to use a system of pins in a spanner for engaging holes in a shoulder on a cable adaptor.

I desire it to be understood, therefore, that these and all other aspects of the present invention are not limited to the particular forms shown and I intend in the appended claims to cover all such variations as come within the scope of the invention as described.

What is claimed is:

1. A method of tightening a cable connector which is inelastically coupled to a cable, the connector being adapted to couple the cable to a mating device, said method comprising the steps of:

providing the cable connector having at least a cable adaptor and a nut, said cable adaptor being adapted to be firmly engaged by a tool, said tool having an adaptor engagement portion with a slot said adaptor engagement portion being adapted to firmly engage said cable adaptor without interferring with said cable;

furnishing a nut driver having a nut engagement portion rotatably disposed around said adaptor engagement portion of said tool and having a cutaway cylindrical portion capable of being aligned with said slot in said tool;

engaging said nut with said nut engagement portion;

passing said cable through said slot in said adaptor engagement portion, and through said cutaway cylindrical portion;

restraining said cable adaptor from rotation about said cable with said tool; and rotating said nut driver and thereby rotating said nut to tighten said cable connector to the mating device.

2. An apparatus for tightening a cable connector to a mating device, said cable connector having at least a cable adaptor and a nut, said cable adaptor being inelastically coupled to said cable, said cable adaptor being adapted to be firmly engaged by a tool, said apparatus comprising in combination:

a tool having a portion adapted for firmly engaging and for preventing rotation of the cable adaptor, said tool having a cylindrical portion with a slot for allowing clearance for the cable; and a nut driver rotatably disposable around said tool for firmly tigtening the nut, said nut driver having an engagement portion shaped to allow said nut driver to firmly engage and to turn the nut, said engagement portion being capable of coaxial rotation around said portion of said tool, said nut driver having a cut away cylinrical portion coaxially arranged around and capable of being aligned with said slot in said cylindrical portion of said tool to form an aperture larger than the cable, said aperture allowing said nut driver to be axially fed and rotated around said tool while providing clearance for the cable.

* * * * *